United States Patent [19]

Campbell

[11] Patent Number: 4,730,568

[45] Date of Patent: Mar. 15, 1988

[54] WATERBORNE CRAFT

[76] Inventor: Brian C. Campbell, P O Box 4091, George East, Cape Province, South Africa

[21] Appl. No.: 14,452

[22] Filed: Feb. 13, 1987

[51] Int. Cl.[4] ..... B63B 7/04; B63B 41/00; A63C 15/05

[52] U.S. Cl. ..... 114/39.2; 114/91; 114/347; 114/352; 440/74; 440/79

[58] Field of Search ..... 114/39, 39.1, 39.2, 114/77 R, 347, 352, 91, 127, 132, 140; 440/74, 79

[56] References Cited

U.S. PATENT DOCUMENTS

| | | | |
|---|---|---|---|
| 890,045 | 6/1908 | Granrose | 114/129 |
| 1,846,963 | 2/1932 | Grogun | 114/352 |
| 2,999,253 | 9/1961 | Lewis | 114/347 |
| 3,158,882 | 12/1964 | Kibby | 441/74 |
| 3,308,493 | 3/1967 | Lambach | 441/74 |
| 3,422,778 | 1/1969 | Halfon | 114/39 |
| 3,824,945 | 7/1974 | Casciano | 441/65 |
| 4,068,611 | 1/1978 | Leather | 114/39 |
| 4,194,458 | 3/1980 | Messing | 114/39.2 |
| 4,455,959 | 6/1984 | Suzuki | 114/39.2 |
| 4,458,859 | 7/1984 | Ganev | 114/39.2 |
| 4,476,798 | 10/1984 | Bachus | 114/77 R |

FOREIGN PATENT DOCUMENTS

| | | | |
|---|---|---|---|
| 3329145 | 8/1983 | Fed. Rep. of Germany . | |
| 2525482 | 10/1983 | France . | |
| 1017590 | 5/1983 | U.S.S.R. | 114/39.2 |

*Primary Examiner*—Sherman D. Basinger
*Attorney, Agent, or Firm*—Harness, Dickey & Pierce

[57] ABSTRACT

A water borne craft includes a smooth rounded elongate sailboard type hull of little depth. The hull tapers down in width and in depth from its middle towards its ends and has smooth upper and lower surfaces. A cockpit extends downwardly into the hull from its upper surface to provide a craft usable in canoe mode. The craft also includes at least one removable reversible insert which fits snugly in two modes into the cockpit. The upper surface of the insert in one mode, being a paddle-ski mode, has recesses to accommodate the buttocks and feet of a paddle skier when the craft is used in the paddle ski mode. The opposite surface of the insert is uppermost in the other mode, being the sailboard mode. The opposite surface has structure for mounting a mast so that the craft can be used as a sailboard in this mode.

9 Claims, 8 Drawing Figures

WATERBORNE CRAFT

This invention relates to water-borne craft.

BACKGROUND OF INVENTION

Water-related recreational activities are becoming increasingly popular. However, for each type of water sport various craft are needed, eg sailboards, paddle skis, canoes, and so on. Most of these types of craft are expensive. In addition, if, for example, members of a family have varying interests, different types of craft would have to be purchased for each member of the family.

It is an object of this invention to provide a water-borne craft which the Applicant believes will alleviate these problems at least to some extent.

BRIEF SUMMARY OF INVENTION

Accordingly, the invention provides a water-borne craft which includes a smooth rounded elongate sailboard hull of little depth and which tapers down in width and in depth from its middle towards its ends, and which has smooth upper and lower surfaces and a cockpit extending downwardly into the hull from its upper surface to provide a craft usable in canoe mode;

at least one removable reversible insert which fits snugly in two modes into the cockpit, the upper surface of the insert in one mode, being the paddle ski mode having recesses to accommodate the buttocks and feet of a paddle skier when the craft is used in this paddle ski mode, and the opposite surface of the insert being uppermost in the other mode, being the saidboard mode, the said opposite surface having mounting means for mounting a mast so that the craft can be used as a sailboard in this mode.

The insert and the hull may have securing means for releasably securing the insert snugly in position in the cockpit for both the paddle ski mode and the sailboard mode. The securing means may include spring clips or quick-release straps or grips which may be of the type presently available under the name VELCRO.

The insert, when seated in the cockpit, in either the paddle ski mode or up-side-down in the sailboard mode, may have its upper surface flush with the upper surface of the hull.

The mounting means for the mast may include a removable socket member slidably mounted and lockable in position along a longitudinal pathway in the insert, the socket member having a socket to accommodate the lower end of a sail mast when the craft is to be used in the sailboard mode. There may be provided a plurality of shoulders spaced longitudinally in series along the pathway. The socket member may have releasable locking means for locking it releasably and adjustably in position against any one of the shoulders in the pathway.

The hull may be in the form of a closed hollow shell of moulded fibreglass, having at least one enclosed air space for buoyancy. The air space may extend under the cockpit and may communicate with air spaces fore and aft of the cockpit.

The craft may further include a longitudinal skeg rail on the underside of the hull to accommodate at least one skeg removably lockable in position along the length of the rail when the craft is to be used in the sailboard mode, the skeg projecting downwardly from the undersurface of the hull. The longitudinal skeg rail may extend from the stern longitudinally, about half the length of the hull, to accommodate also a dagger board. An additional skeg or a dagger board may be provided, spaced longitudinally from the said at least one skeg. The skeg may include a skeg slide engageable with the rail, and a skeg fin mounted on the skeg slide, to be arcuately adjustable in position about a transverse axis relative to the skeg slide.

The insert may be of buoyant material, permitting it to be used surfboard fashion.

The invention will now be described by way of example with reference to the accompanying diagrammatic drawings.

DETAILED DESCRIPTION

Figure 1:
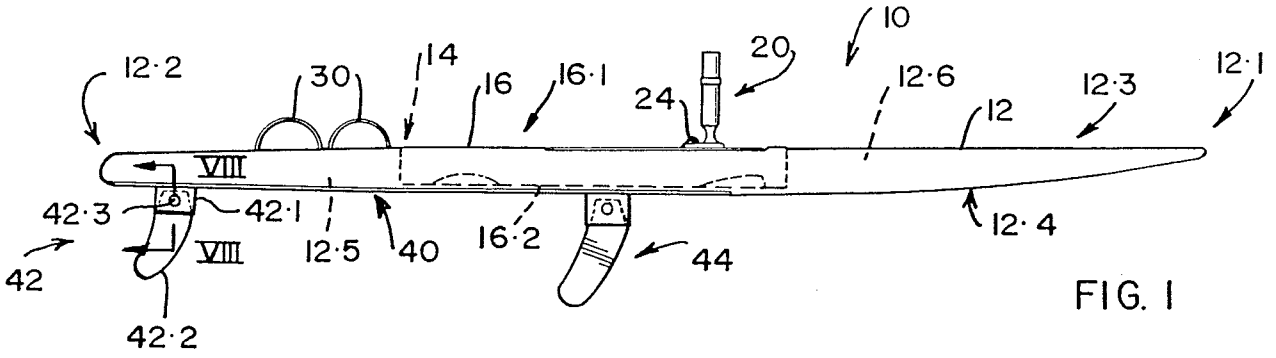
FIG. 1 shows, in side elevation, a water-borne craft in accordance with the invention.
Figure 2:
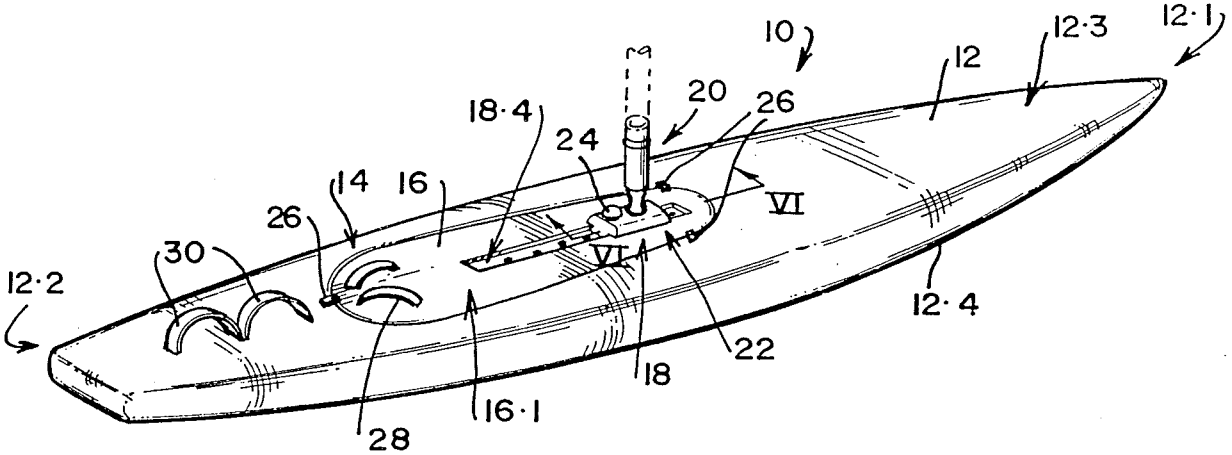
FIG. 2 shows an oblique rear side view of the craft shown in FIG. 1.
Figure 3:
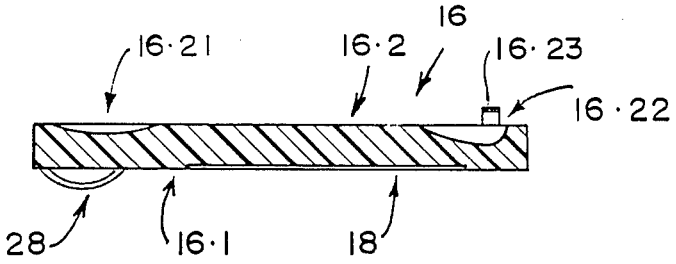
FIG. 3 shows a sectional side elevation at V—V in FIG. 4 of an insert forming part of the craft in accordance with the invention.
Figure 4:
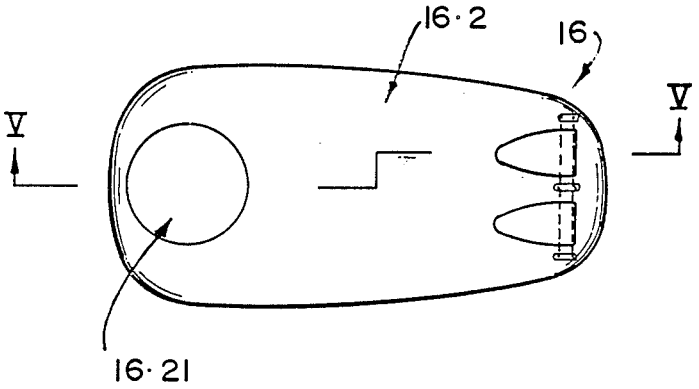
FIG. 4 shows a plan view of the insert corresponding to FIG. 3.
Figure 5:
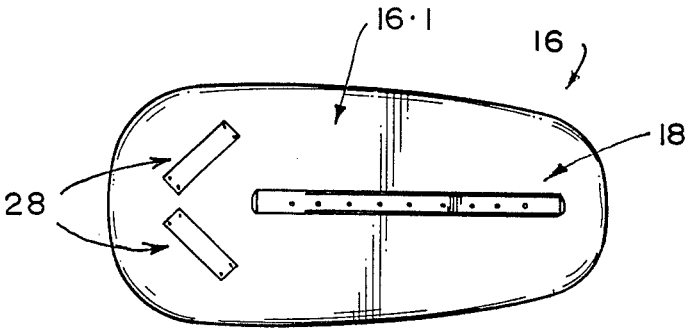
FIG. 5 shows a plan view of the opposite side of of the insert, in a direction opposite to that of FIG. 4.
Figure 6:
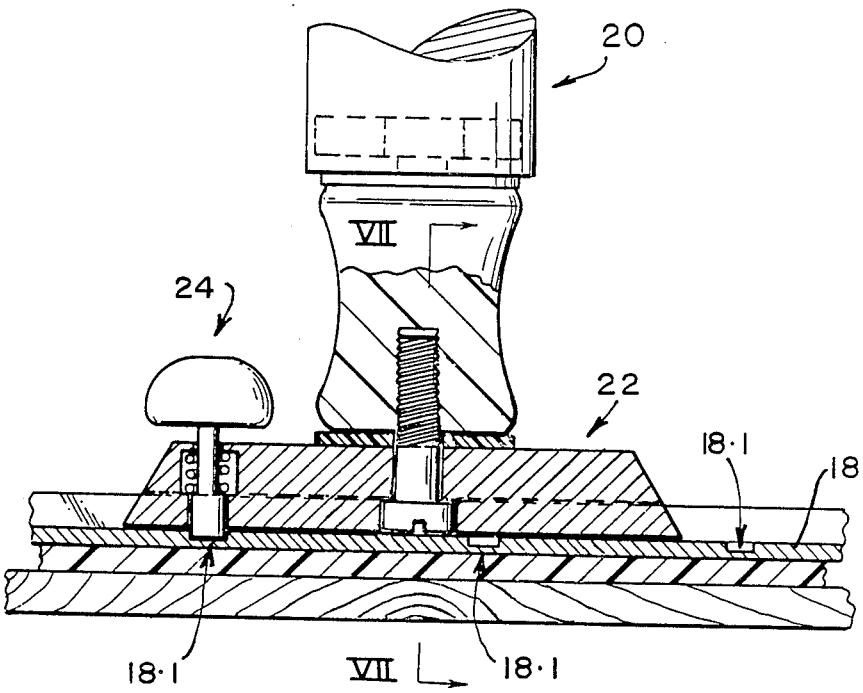
FIG. 6 shows a sectional elevation, to a larger scale, at VI—VI in FIG. 2.
Figure 7:
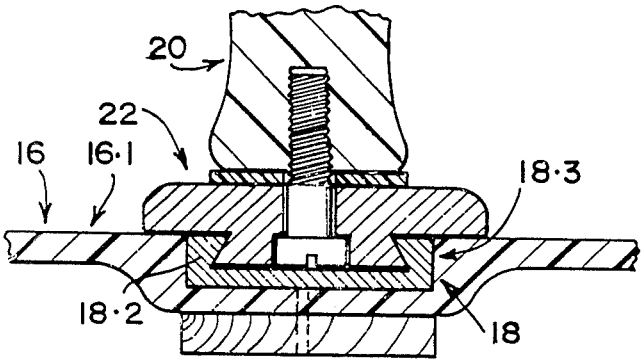
FIG. 7 shows a sectional elevation at VII—VII in FIG. 6.
Figure 8:
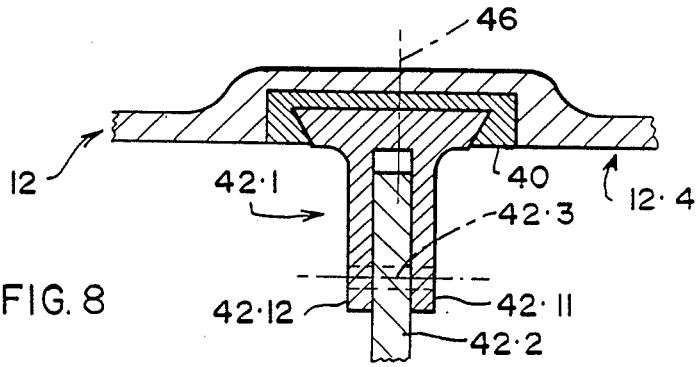
FIG. 8 shows a sectional elevation, to a larger scale, at VIII—VIII in FIG. 1.

Referring to the drawings, reference numeral 10 refers generally to a water-borne craft in accordance with the invention. The craft includes a smooth rounded elongate sailboard-type hull 12 of little depth which tapers down in width and in depth from its middle region towards its ends 12.1 and 12.2. It has a smooth upper surface 12.3 and a smooth lower surface 12.4. The craft further has a cockpit 14 which extends downwardly into the hull from its upper surface 12.3, to provide a craft usable in canoe mode.

The craft further includes a removable reversible insert 16 which fits snugly in two modes into the cockpit 14. The upper surface 16.1 of the insert in one of the modes, being the sailboard mode, has mounting means including a rail 18 defining a longitudinal pathway for mounting a mast 20 for a sail, so that the craft can be used as a sailboard in this mode. When the insert 16 is turned over so that its surface 16.2 is uppermost, then the craft can be used in the other mode, being the paddle-ski mode.

In sailboard mode, the insert 16 has its surface 16.1 uppermost. The mast 20 has a mast slide 22 with a locking pin 24 whereby the slide 22 can be locked in position along the length of the rail 18 by engaging with shoulders 18.1 spaced longitudinally along the pathway defined by in the rail 18.

The insert 16 has releasable securing means 26 in the form of VELCRO strips which permit the quick release of the insert, and quick removal or reversing of the insert in the cockpit 14. The insert has mating strips on opposite surfaces 16.1 and 16.2 for co-operating with the VELCRO strips 26, so that it can be securely held in position in the cockpit. The insert 16, whichever surface 16.1 or 16.2 is uppermost, has it surface flush with the upper surface 12.3 of the hull.

The slide 22 is removable from the longitudinal pathway defined by the rail 18. Removability is provided by dispensing with the side flanges 18.2 and 18.3 of the rail 18, near one end 18.4. The insert has foot straps 28 which may be removable. The hull also has foot straps 30.

The hull 12 is formed as a closed hollow shell of moulded fibreglass, and has two air spaces 12.5 and 12.6, one fore and one aft of the cockpit 14.

The hull may be provided with a longitudinal skeg rail 40 on the underside of the hull. At least one skeg, generally indicated by reference numeral 42, may be removably lockable in position along the length of the rail 40 when the craft is used in sailboard mode, the skeg projecting downwardly as shown in FIG. 1 of the drawings, from the undersurface 12.4 of the hull. The longitudinal skeg rail extends from the stern end 12.2 where it has an open end, longitudinally about half the length of the hull, to accommodate also a dagger board, generally indicated by reference numeral 44, longitudinally spaced from the skeg 42.

In order to provide for adjustability, the skeg 42 is made in two parts, namely a skeg slide 42.1 and a skeg fin 42.2, which is pivotally mounted on the skeg slide about the axis of a bolt or pin 42.3, the root end of the blade 42.2 being clamped between flanges 42.11 and 42.12. The skeg slide 42.1 is secured in position relative to the rail 40 by means of screws at centre lines 46, screwed into the rail 40.

The mounting of the dagger board 44 is similar to that described with reference to the skeg 42.

The insert 16, when used for paddle ski mode, will have its surface 16.2 uppermost in the hull. The upper surface 16.2 has recesses 16.21 to accommodate the buttocks of a paddle skier, and recesses 16.22 to accommodate his feet. Straps 16.23 are also provided to provide additional purchase for his feet.

The insert, when removed from the hull, can itself be used surfboard fashion, with either surface 16.1 or 16.2 uppermost. The straps 16.23 and 28 will serve as handholds for the person using the insert as a surfboard.

The invention therefore provides a versatile waterborne craft which can be used in any one of several modes. In this way, it can meet the needs of a family having different interests regarding water sport, because of its capability of being used in different modes.

I claim:

1. A waterborne craft which includes a. smooth rounded elongate sailboard type hull of little depth and which tapers down in width and in depth from its middle towards its ends and which has smooth upper and lower surfaces and a cockpit extending downwardly into the hull from its upper surface to provide a craft usable in canoe mode; and at least one removable reversible buoyant surfboard-like insert which fits snugly in two modes into the cockpit, the upper surface of the insert in one mode, being the paddle-ski mode, having recesses to accommodate the buttocks and feet of a paddle skier when the craft is used in this paddle-ski mode, and the opposite surface of the insert being uppermost in the other mode, being the sailboard mode, the said opposite surface having mounting means for mounting a mast so that the craft can be used as a sailboard in this mode, the insert being usable surfboard fashion by itself independently of the hull.

2. A craft as claimed in claim 1, in which the insert and the hull have securing means for releasably securing the insert snugly in position in the cockpit for both the paddle-ski mode and the sailboard mode, the insert having its upper surface flush with the upper surface of the hull when seated in the cockpit in either the paddle-ski mode or up-side-down in the sailboard mode.

3. A craft as claimed in claim 1, in which the mounting means for the mast include a removable mast slide slidably mountable and lockable in position along a recessed, open-ended longitudinal pathway in the insert, the mast slide having mast slide securing means for securing the lower end of a sail mast to it when the craft is to be used in the sailboard mode.

4. A craft as claimed in claim 3, in which there is provided a plurality of shoulders spaced longitudinally in series along the length of the pathway, and in which the mast slide has releasable locking means for locking it releasably and adjustably in position along the length of the pathway against any one of the shoulders in the pathway, the pathway being defined by a rail comprising a web and laterally spaced sloping convergent side flanges defining an upwardly open pathway of dovetail cross-sectional shape, and the mast slide having a complementary dovetail cross-sectional shape fitting snugly and slidably in the pathway.

5. A craft as claimed in claim 1, in which there is provided a longitudinal skeg rail recessed into the undersurface on the underside of the hull, and at least one skeg removably lockable in position and slidable along the length of the rail when the craft is to be used in sailboard mode, the skeg projecting downwardly from the undersurface of the hull at its stern, and the skeg rail comprising a web and laterally spaced sloping side flanges defining a downwardly open pathway of dovetail cross-sectional shape open at its stern end to permit complete removal of the skeg when the hull is to be used in canoe mode, the skeg comprising a skeg slide having a complementary dovetail cross-sectional shape fitting snugly and slidably in the pathway of the skeg rail.

6. A craft as claimed in claim 5, in which the longitudinal skeg rail extends from the stern longitudinally, about half the length of the hull to accommodate slidingly also a removable additional skeg or daggerboard, and in which an additional skeg or a daggerboard is provided towards the middle of the hull, spaced longitudinally inwardly away from the stern from the said at least one skeg, the additional skeg or the daggerboard having a skeg slide or daggerboard slide having a complementary dovetail cross-sectional shape fitting snugly and slidably in the pathway of the skeg rail.

7. A craft as claimed in claim 6, in which the additional skeg or daggerboard includes an additional skeg fin or daggerboard fin clamped to the additional skeg slide or daggerboard slide, to be arcuately adjustable in position about an axis which is disposed transversely to the length of the hull.

8. A craft as claimed in claim 5, in which the skeg further includes a skeg fin clamped to the skeg slide, to be arcuately adjustable in position, about an axis which is disposed transversely to the length of the hull.

9. A craft as claimed in claim 1, in which the insert has straps over the foot recesses in its upper surface, and straps at one end on its undersurface for the feet of a user when the craft is being used in sailboard mode, the sail straps on the upper and lower surfaces of the insert serving as handholds for a user when the insert is being used by itself in surfboard mode, independently of the hull.

* * * * *